United States Patent [19]

Stringer et al.

[11] Patent Number: 5,013,251

[45] Date of Patent: May 7, 1991

[54] ADAPTOR AND MECHANISM FOR GROUNDING A TRACK LIGHT SYSTEM

[75] Inventors: Ralph S. Stringer, Gardena; Horace L. Green, Jr., Lynwood, both of Calif.

[73] Assignee: Marco/Marvin Electric Manufacturing Co., Los Angeles, Calif.

[21] Appl. No.: 389,608

[22] Filed: Aug. 4, 1989

[51] Int. Cl.[5] ..... H01R 4/66

[52] U.S. Cl. ..... 439/94; 439/118

[58] Field of Search ..... 439/94, 118, 116, 117, 439/119

[56] References Cited

U.S. PATENT DOCUMENTS 3,611,252 10/1971 Fremont ..... 439/118

4,699,439 10/1987 Cohen ..... 439/119 X

*Primary Examiner*—Eugene F. Desmond

*Attorney, Agent, or Firm*—Lyon & Lyon

[57] ABSTRACT

A connector apparatus or adaptor for use in a track-lighting system is provided which includes a grounding leaf to effect electrical contact between a grounded metallic track and a grounding conductor or grounding wire in the connector apparatus. The grounding leaf is slidably mounted onto the floor of the connector apparatus and provides an upwardly protruding lip which is placed in contact with an arm of the metallic track upon locking engagement therewith.

16 Claims, 1 Drawing Sheet

ADAPTOR AND MECHANISM FOR GROUNDING A TRACK LIGHT SYSTEM

BACKGROUND OF THE INVENTION

The field of the present invention is that of connector apparatus or adapters for securing an electrical appliance to an electrical power distribution track such as the type that is utilized in track-lighting. More particularly, the present invention concerns connector apparatus having a novel and improved mechanism for grounding for use with a grounded track.

Electrical power distribution tracks to which light fixtures or electrical outlets may be connected at any given point by the use of adapters or connector apparatus, are well known to the field of interior lighting. Typically, the track contains a slot for housing insulating inserts which support electrical current-carrying conductors. The track is usually made of metal while the insulating inserts are made of an insulated plastic material such as polyethylene.

The connector apparatus consists of a body with a plug protruding therefrom for engagement with the slot of the track. Ridges or ledges are provided on the plug to engage corresponding ledges or ridges in the slot of the track for attachment of the connector apparatus to the track. Electrical contacts on the plug of the connector apparatus engage the current-carrying conductors in the slot of the track to provide electric power to lighting fixtures, electrical outlets or other electrical appliances attached to the connector apparatus. For safety reasons, a line separate from the current-carrying lines and conductors must be provided to ground these fixtures, outlets and appliances.

One type of grounding system well known in the prior art provides a grounding contact or tab in the plug of the conductor apparatus which engages a ground conductor insulated in the track slot. However, this type of grounding mechanism proves unsatisfactory because in addition to supporting a hot and neutral conductor bus bar, the slot of the track must also support a grounding conductor bus bar which adds to the complexity, weight and cost of the track.

Another type of grounding system developed to alleviate some of the above-mentioned problems provides the grounding conductor in the connector apparatus. For example, as shown in Republic of China Patent No. UM-32635 to R. S. Stringer, a grounding conductor in the connector apparatus includes a spring loaded metallic spike that is biased against a grounded metallic track to effect electrical contact therebetween thus eliminating the need for an additional conductor bus bar in the track.

However, although the spike grounding system may reduce the cost, weight and complexity of the track, it still has an overly complex connector apparatus which requires an excessive number of parts due to the placement of the grounding conductor therein.

SUMMARY OF THE INVENTION

The present invention is directed to an improved mechanism for grounding a connector apparatus and attached appliances to the track of a track lighting system. To this end, it is an object of the present invention to provide a less complex connector apparatus which can be utilized with an electrical distribution track containing only two conductor bus bar in the slot of the track in order to reduce the cost and weight of the connector apparatus and simplify its construction and which also enhances grounding continuity contact.

The above advantages are provided by connecter apparatus of the present invention which utilize a grounding leaf to effect electrical contact between a grounded metallic track and a grounding conductor or wire in the connector apparatus. The grounding leaf is comprised of a metallic strip a portion of which is sandwiched between the track and connector apparatus when the connector apparatus engages the track and a lip that protrudes therefrom for grounding contact with the track. Other and further objects and advantages will appear hereinafter.

DETAILED DESCRIPTION OF THE PREFERRED EMBODIMENT

Figure 1:
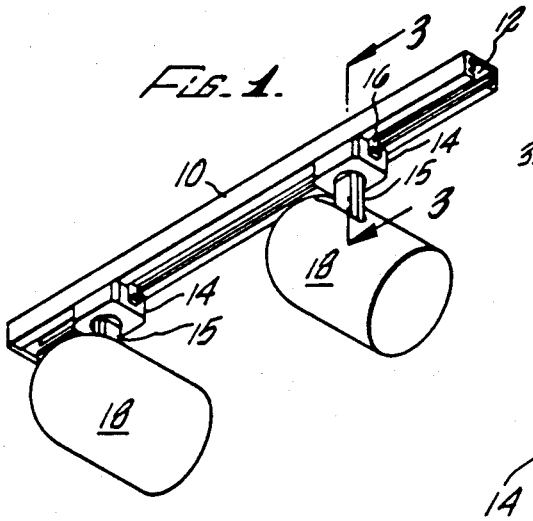
FIG. 1 illustrates a perspective view of two lighting fixtures mounted on connector apparatus of the present invention which are in turn secured to an electrical power distribution track.

Turning in detail to the drawings, FIG.1 illustrates a track 10 supporting a pair of track lights 18 employing the connector apparatus 14 of the present invention. The track lights 18 are attached to a stem 15 which, in turn, is attached to the connector apparatus 14. The connector apparatus 14 engages the track 10 via a track slot 12 provided therein. An alignment mechanism 16 is provided on the connector apparatus 14 and enters the track slot 12 in order to properly position the connector apparatus 14 therein.

Figure 3:
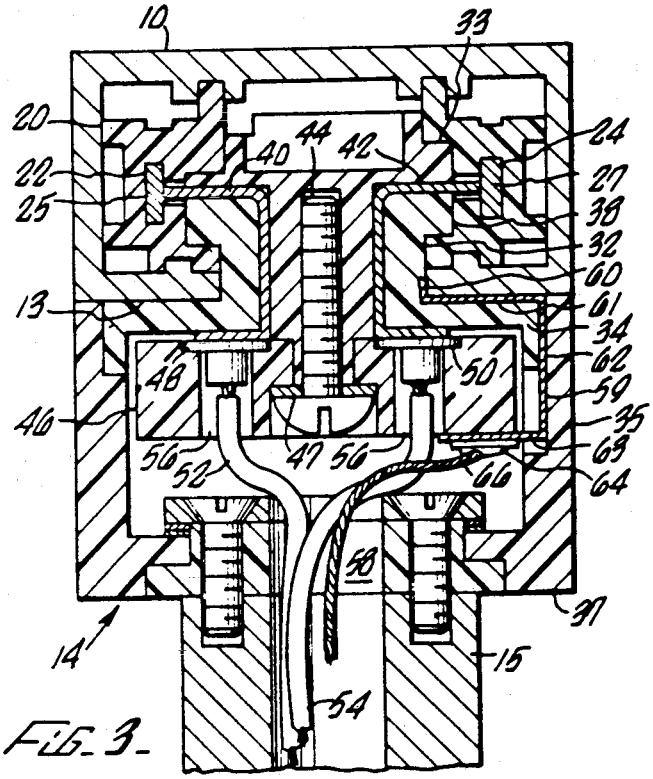
FIG. 3 is an enlarged cross-sectional view of a connector apparatus of the present invention mounted in a track.

FIG. 3 is an enlarged cross-sectional view along lines 3—3 of FIG. 1 illustrating the connector apparatus 14 mounted in the track 10. The track 10 is made of a metal having the requisite durability and strength to support light fixtures or other appliances and may vary in length depending upon the number of track lights or other appliances that need to be supported. Because the track 10 is made of metal, it must be properly grounded in order to prevent dangerous shocks in the event of a short. A cross-section of the track 10 resembles a rectangular box containing a slot or opening 12 on the underside of the track 10. The slot 12 allows entry of a portion of the connector apparatus 14 into the track 10 for electrical and mechanical attachment. A track arm or ledge 13 exists on opposite sides of the slot 12 and supports a pair of track insulator inserts 20. The insulating inserts 20, formed of a resilient insulating plastic material such as polyethylene, are molded to provide a first channel 25 for supporting a first track conductor 22 or second track conductor 24 and a second channel 27 for supporting the connector apparatus 14 upon locking engagement therewith. That is, the first track conductor 22 is embedded in the first channel 25 of one of the insulating inserts 20 while the second track conductor 24 is embedded in the first channel 25 of the other insulating insert 20. The track conductors, which are made of copper or any other suitable conducting material, are formed into strips or rails having rectangular cross-sections.

The connector apparatus 14 is comprised of a connector casing 35, a connector plug body 32 and a plug insert 33. The connector casing 35 is comprised of a north wall 27, south wall 28, east wall 29, west wall 30 and a connector casing base 37 and is attached to the connector plug body 32 via a plug support floor 34 which is integrally formed with the plug body 32. The plug body 32 and plug support floor 34 are secured to the connector casing 35 via a pair of screws 36 (See FIG.4). The plug insert 33 is inserted into the plug body 32 and secured therein via a holding block 46 and a plug screw 44. Together the connector casing 35, plug body 32 and plug insert 33, which are all made of a durable plastic such as polycarbonate, define a roughly cubical box with a plug-like protrusion from one end thereof. The connector plug body 32 and plug insert 33 are formed to include a pair of plug shoulders 38 for locking engagement with the second channels 27 of the insulator inserts 20.

Figure 4:
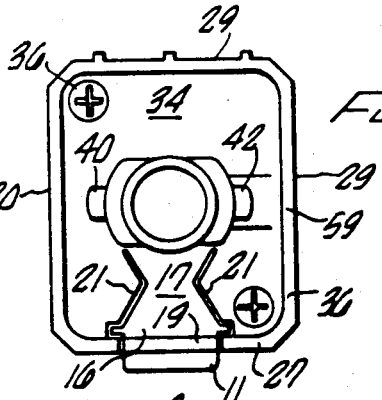
FIG. 4 is an enlarged plan view of the plug end of the connector apparatus of the present invention.
Figure 5:
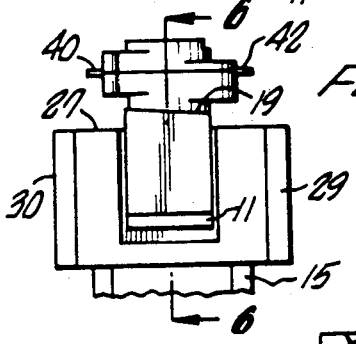
FIG. 5 is a side view of the north side of the connector apparatus illustrating the alignment mechanism.
Figure 6:
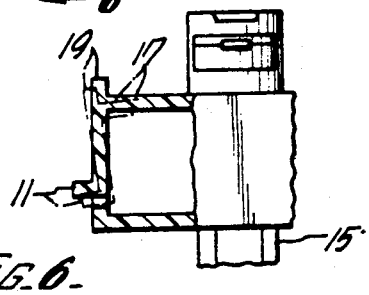
FIG. 6 is a cross-sectional view of the alignment mechanism along line 6—6 of FIG.5.

As illustrated in FIGS. 4, 5 and 6 the plug body 32 is further comprised of an alignment mechanism 16 integrally formed with the plug support floor 35. The alignment mechanism 16 is comprised of an alignment tab foot 11, an alignment tab body 13, an alignment tab arm 17 and an alignment tab head 19 all of which are integrally formed with each other. The alignment tab arm 17 is defined by a pair of notches 21 cut into the plug support floor 34 which extend from a position just below the plug shoulders 38 of the plug insert 33 to the edge of the plug support floor 34 in the general direction of the north wall 27 of the connector casing 35. The alignment tab arm 17 is substantially perpendicular to the alignment tab body 13 which is shaped to fit into a cut-away portion of the north wall 27 of the connector casing 35. The alignment tab foot 11 perpendicularly protrudes from the lower end of the alignment tab body 13 and extends out past the north wall 27 of the connector casing 35. The alignment tab head 19 is an extension of the alignment tab body 13 and perpendicularly extends out past the plug support floor 34. A slight grade is provided across the top of the alignment tab head 19. As illustrated in FIG. 6, when pressure is applied to the alignment tab foot 11 depressing the foot 11 into the connector casing 35 the alignment tab arm 17 .orsionally rotates into the plug support floor 34 thereby moving the alignment tab head 19 downward into the plug support floor 34.

When the connector apparatus 14 is attached to the track 10 the alignment tab head 19 slips into the track slot 12 in order to further secure the connector apparatus 14 thereto. As will be discussed further hereinafter, the alignment tab head 19 allows the connector apparatus 14 to maintain its position in operational alignment with the track 10 by preventing the connector apparatus 14 from rotating about the axis generally defined by a connector plug screw 44. To remove the connector apparatus 14, pressure is applied to the alignment tab foot 11 depressing the foot 11 into the connector casing 35. Torsional rotation is thereby imparted to the alignment tab arm 17 causing the alignment tab head 19 to be lowered out of locking engagement with the track slot 12 enabling rotation of the plug body 32 within the track slot 12 so that the plug shoulders 38 are no longer held by the second channels 27 in the insulating inserts 20. The slight grade in the alignment tab head 19 is provided to reduce the distance that the head 19 must be lowered in order to move it out of locking engagement with the track slot 12 and allow rotation of the plug body 32 to a position where the plug body 32 can then slip out of the track slot 12.

Mounted in the plug body 32 is a first metallic contact 40 and a second metallic contact 42 which, upon locking engagement within the track 10, respectively engage first track conductor 22 and second track conductor 24. When the plug body 32 of the connector apparatus 14 is rotated into locked engagement with the track 10 direct electrical contact is established between the metallic contacts 40, 42 and the track conductors 22, 24. The metallic contacts 40, 42 are supported between the inner wall of the plug body 32 and the plug insert 33. The plug insert 33 is secured within the plug body 32 by a plug screw 44 which also secures a holding block 46 to the plug support floor 34. A washer 47 is provided between the plug screw 44 and the holding block 46.

The holding block 46 further supports and presses a first conducting line contact stud 48 and a second conducting line contact stud 5 against the first metallic contact 40 and second metallic contact 42, respectively. The first and second conducting line contact studs 48, 50 are respectively attached to a first conducting line 52 and a second conducting line 54. The first and second conducting lines 52, 54 pass through respective apertures 56 in the holding block 46 and exit the connector apparatus 14 through an opening 58 in the floor of the connector casing 35 and stem 15 to provide electrical power to the track light or other appliance attached to the stem 15. In other embodiments the track light or appliance may be attached directly to the connector apparatus 14. Thus, it is not necessary to include a stem 15 between the connector apparatus 14 and the track light or appliance 18.

The connector apparatus 14 also provides a grounding means wherein direct electrical contact is established between a grounding leaf 59 and the metal track 10. The grounding leaf 59 is a generally rectangular strip of electrically conductive metal shaped to include a contact lip 60, a top section 61, a side section 62 and a bottom section 63. As illustrated in FIG. 3, contact lip 60 is a somewhat sharp piece of metal that protrudes upwardly from and curves back over the top section 61 of the grounding conductor 59. The top section 61 and bottom section 63 are substantially parallel to each other. Both are connected and substantially perpendicular to side section 62. The grounding leaf 59 is configured such that the top section 61 and bottom section 63 slidably engage the plug support floor 34 and the holding block 46, respectively, while the side section 62 is sandwiched between the inner surface of the connector casing 35 and portions of the plug support floor 34 and the holding block 46. Thus, the grounding conductor 60 is secured to the connector apparatus with the top section 61 lying flush with the face of the plug support floor 34 and the contact lip 60 curved up from and back over the top section 61. As will be further discussed hereinafter, the contact leaf 60, which is now in position to engage the track arm 13, is shaped such that it will scrape the metal of the track arm 13 upon rotational engagement of the connector apparatus thereto. A grounding stud 64 secures a grounding conductor or grounding wire 66 to the bottom section 63 of the grounding leaf 59. The grounding wire 66 then passes through the opening 58 in the floor of the connector casing 35 and stem 15 and is subsequently attached to the track light or appliance.

As best illustrated in FIG. 4, the plug body 32 is rectangularly shaped with the longer sides running generally parallel with the north wall 27 and south wall 28 and the shorter sides running generally parallel with the east wall 29 and west wall 30. This configuration permits the plug body 32 to be inserted into the slot 12 of track 10 when the longer sides are aligned parallel with the slot 12. Similarly, the configuration allows the plug shoulders 38 to engage the track 12 upon rotation of the plug body 32 therein.

In operation, the plug body 32 is inserted into the slot 12 of the track 10 such that the plug shoulders 38 of the plug body 32 linearly coincide with the slot 12 of the track 10. The pressure applied when inserting the plug body 32 into the slot 12 will automatically cause the alignment tab head 19 to depress into the plug support floor 34. The plug body 32 is then rotated approximately 90 degrees so as to bring the plug shoulders 38 of the plug body 32 into locking engagement with the second channels 27 of the insulator inserts 20 thereby securing the connector apparatus 14 to the track 10. When the connector plug body 32 is inserted into the slot 12 of the track 10, and rotated into locking engagement therewith, the plug shoulder 38 engages the second channel 27 while the metallic contacts 40, 42 are brought into contact with the track conductors 22, 24 in the first channels 25 of the insulating insert 20. In addition, the alignment tab head 19 is torsionally biased into track slot 12 and locking engagement with the track arms 13. Thus, rotation of the connector apparatus 14 is prevented thereby maintaining electrical and mechanical alignment inside the track slot 12. As the connector apparatus 14 is rotated into locking engagement with the track 10 the contact lip 60 scrapes against the track arm 13 removing a minimal amount of metal therefrom establishing a grounding contact with the track 10. Thus, once the connector apparatus is securely mounted to the track 10, the top portion 61 of the grounding leaf 59 is sandwiched between the plug support floor 34 and the track arm 13 with the contact lip 60 protruding upwardly from the top portion 61 into the track arm 13. Thus, direct electrical contact and grounding is established between the metal track 10 and the connector apparatus 14.

Figure 2:
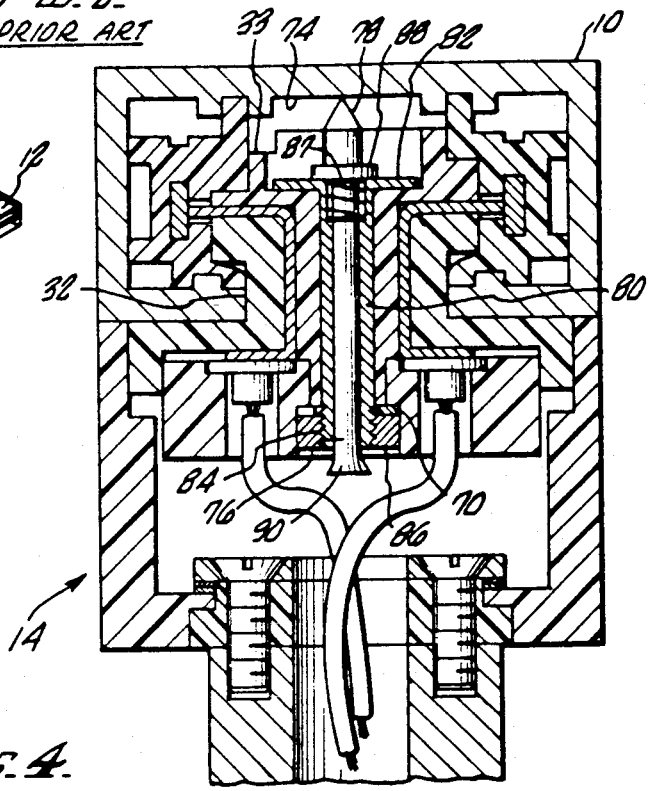
FIG. 2. PRIOR ART
FIG. 2 is an enlarged cross-sectional view along lines 3—3 of FIG. 1 of a connector apparatus which utilizes a spring loaded metallic spike mechanism mounted in a track.

As compared with the prior art connector apparatus illustrated in FIG. 2, the present invention discloses a grounding system that reduces the number of parts that are necessary in a connector apparatus thereby reducing its cost, weight and complexity. A brief description of the apparatus in FIG. 2 will help illustrate some of the parts that are no longer necessary as a result of the present invention. For convenience, the prior art invention shown in FIG. 2 is embodied in a connector apparatus and track similar in some respects to that of the present invention shown in FIG. 3. Accordingly, the numbering of components will remain the same where components in FIG. 2 are similar to components in FIG. 3.

The connector apparatus 14 shown in FIG. 2 employs a grounding means wherein direct electrical contact is established between a ground conductor base socket 70 and the metal track 10. This is basically accomplished by utilizing a spring loaded metallic spike 76 which contains a metallic point 78 which is biased against the track slot bottom 74.

The spike 76 is slidably located in a spike housing 80 which completely penetrates the plug insert 33. The housing 80, which is made of an electrically conductive metal, is provided with threading 84 at one end thereof. The threading 84 allows a nut 86 to secure the housing 80 so that it cannot be drawn out of the connector apparatus 14. The nut 86 also secures a base socket 70 of the grounding spike 76 against the plug body 32 and ensures electrical contact between the base socket 70 and the housing 80. The housing 80 also provides a raised ledge 82 formed at the upper end of the housing 80 in order to prevent the housing 80 from being biased or forced into the connector apparatus 14. The spike 76 is secured within the housing 80 by means of a flange 90 formed at the lower end of the spike 76 nearest to the nut 86 which prevents the spike 76 from being drawn out of the housing 80. A raised ridge 88 is also provided on the spike 76 to limit the distance that the spike 76 may descend into the housing 80 by acting as a blocking means against the raised ledge 82 of the housing 80. A spike biasing spring 87 is positioned between the housing 80 and the raised ridge 88 concentrically surrounding a portion of the spike 76.

The spike biasing spring 86 tends to urge the spike 76 out of the housing 80 to the exterior of the connector apparatus 14. When the connector apparatus 14 is attached to the track 10, the point 78 of spike 76 is biased against the bottom of the track slot 74 thereby establishing electrical contact between the spike 76 and the metal track 10. In turn, the spike 76 is in electrical contact with the metal of the housing 80, the grounding conductor base socket 70, the lower end of the spike 76 and, finally, to the track light or appliance 18 attached to the connector apparatus 14.

Thus, a less complex connector apparatus is disclosed which can be utilized with a grounded metallic track containing two conductor bus bars. In addition, the grounding means as disclosed herein enhances grounding continuity contact. Although a preferred embodiment of the invention has been illustrated and described with reference to the accompanying drawings, those skilled in the art will understand that the preferred embodiment is by way of example and that changes and modifications may be made without departing from the spirit and scope of the inventive concepts herein. The invention, therefore, is not to be restricted except in the spirit of the impending claims.

What is claimed is:

1. A connector apparatus for providing electrical power at any given point along a grounded metallic track of the type having a slot defined by a first arm and a second arm and containing an exposed first conductor and an exposed second conductor, insulated from each other and from the track comprising:

a connector casing having an open end for receiving a connector body attached to a connector floor which covers said open end and having an engagement means for mating the connector body with the track, wherein said connector body supports a ground conductor, a first conducting line and a second conducting line;

a first electrical connecting means and a second electrical connecting means for placing the first conducting line and the second conducting line in electrical contact with the first conductor and the second conductor, respectively, wherein the first electrical connecting means and the second electrical connecting means are secured to the engagement means for mating the connector body with the track; and a grounding means for establishing direct electrical contact between the track and the ground conductor, the grounding means being slidably secured to an upper surface of the connector floor and sandwiched between the connector floor and one of said arms of the track when the connector apparatus is mated with the track.

2. The connector apparatus of claim 1 in which the grounding means is a metallic strip having a first section engaged with the upper surface of the connector floor and substantially perpendicular to a second section and substantially parallel to a third section engaged with a lower surface underneath the connector floor, and a lip that protrudes upwardly from said first section towards one of said arms of the track when the connector apparatus is attached to the track.

3. The connector apparatus of claim 2 in which said lip engages one of said arms of the track when the connector apparatus is attached to the track.

4. A connector apparatus, comprising:

a connector housing having a platform with an upper surface and a protrusive member extending perpendicularly therefrom, said connector housing securing a ground conductor, a first conducting line and a second conducting line therein;

a first contacting member and a second contacting member mounted to the protrusive member and electrically engaging the first conducting line, respectively;

a grounding mechanism electrically connected to the ground conductor and configured to be wrapped around the upper surface of the platform and a lower surface thereunder.

5. The connector apparatus of claim 4 in which a portion of the grounding mechanism lies flush with the upper surface of the platform.

6. The connector apparatus of claims 4 or 5 in which the grounding mechanism comprises an upwardly protruding lip electrically attached thereto.

7. The connector apparatus of claim 4 or 5 in which the grounding mechanism comprises a first section substantially perpendicular to a second section and substantially parallel to a third section.

8. A connector apparatus for electrically and mechanically engaging a grounded track having a first arm supporting a first partially insulated conductor generally opposite of a second arm supporting a second partially insulated conductor and a slot formed therebetween, comprising:

a connector body supporting a plug protruding from a connector floor, the plug having a first shoulder and a second shoulder for mechanically engaging the first arm and second arm of the track, respectively, upon insertion and rotation of the plug into the slot;

a first conducting line and a second conducting line projecting from the first shoulder and second shoulder of the plug, respectively, positioned to electrically engage the first conductor and second conductor, respectively, upon insertion and rotation of the plug into the slot; and a grounding strip slidably secured to the connector floor such that a portion of the grounding strip mounted flush with the connector floor is sandwiched between the plug and one of the arms of the track and electrically engages the arm of the track upon insertion and rotation of the plug into the slot.

9. The connector apparatus of claim 8 further comprising an alignment mechanism secured to the floor of the connector apparatus having an alignment tab biased to engage the track slot when the connector apparatus is attached to the track so that the correct alignment for electrical contact is maintained.

10. The connector apparatus of claim 8 wherein the alignment mechanism is integrally formed with the floor of the connector apparatus.

11. The connector apparatus of claim 10 further comprising a pair of notches cut into the floor of the connector body to allow flexible up and down movement of the alignment tab.

12. The connector apparatus of claims 9, 11 or 11 in which a depressing means is provided on the alignment mechanism for removing the alignment tab from locking engagement with the track slot.

13. A connector apparatus for electrically and mechanically engaging a grounded track having a first arm supporting a first partially insulated conductor generally opposite of a second arm supporting a second partially insulated conductor and a slot formed therebetween, comprising:

a connector body supporting a plug protruding from a connector floor, the plug having a first shoulder and a second shoulder for mechanically engaging the first arm and second arm of the track, respectively, upon insertion and rotation of the plug into the slot;

a first conducting line and a second conducting line projecting from the first shoulder and second shoulder of the plug, respectively, positioned to electrically engage the first conductor and second conductor, respectively, upon insertion and rotation of the plug into the slot;

a grounding strip mounted such that a portion of the grounding strip mounted flush with the connector floor is sandwiched between the plug and one of the arms of the track and electrically engages the arm of the track upon insertion and rotation of the plug into the slot; and an alignment mechanism secured to the floor of the connector apparatus having an alignment tab shaped to include a grade across the top of the alignment tab and biased to engage the track slot when the connector apparatus is attached to the track so that the correct alignment for electrical contact is maintained.

14. The connector apparatus of claim 13 wherein the alignment mechanism is integrally formed with the floor of the connector apparatus.

15. The connector apparatus of claim 14 further comprising a pair of notches cut into the floor of the connector body to allow flexible up and down movement of the alignment tab.

16. The connector apparatus of claims 13, 14, or 15 further comprising a depressing means on the alignment mechanism for removing the alignment tab from locking engagement with the track slot.

* * * * *